US006164166A

United States Patent [19]

Whiteford

[11] Patent Number: 6,164,166

[45] Date of Patent: Dec. 26, 2000

[54] LOW-PROFILE RATCHET WRENCH HAVING MAGNETICALLY RETAINED THIN-WALLED SOCKETS

[76] Inventor: Carlton L. Whiteford, 3 High Point Rd., Westport, Conn. 06880

[21] Appl. No.: 09/287,727

[22] Filed: Apr. 7, 1999

[51] Int. Cl.[7] ..... B25B 13/46

[52] U.S. Cl. ..... 81/63.1; 81/63.2; 81/60

[58] Field of Search ..... 81/63.2, 63.1, 81/63, 180.1, 125, 185.2, 60, 61, 62, 438

[56] References Cited

U.S. PATENT DOCUMENTS

| | | | |
|---|---|---|---|
| 2,570,779 | 10/1951 | Dodge et al. | 81/62 |
| 2,806,396 | 9/1957 | Miller | 81/125 |
| 4,924,733 | 5/1990 | McKenzie | 81/438 |
| 5,259,278 | 11/1993 | Leas | 81/180.1 |
| 5,361,656 | 11/1994 | Starr | 81/180.1 |
| 5,603,248 | 2/1997 | Eggert et al. | 81/438 |
| 5,724,873 | 3/1998 | Hillinger | 81/451 |
| 5,857,390 | 1/1999 | Whiteford | 81/62 |
| 5,913,954 | 6/1999 | Arnold et al. | 81/63.2 |

OTHER PUBLICATIONS

"Armstrong Eliminator", Danaher Tool Group brochure, 4 pages, Oct. 1997, Appl. Pat. No. 5,857,390.

*Primary Examiner*—James G. Smith
*Assistant Examiner*—Hadi Shakeri
*Attorney, Agent, or Firm*—Spencer E. Olson

[57] ABSTRACT

A light-weight, low-profile socket wrench system includes a set of thin-walled sockets, each having a round peripheral surface around which a multiplicity of gear-like teeth are distributed, and a ratchet wrench having a cylindrical opening in its head in which a socket is releasably maintained, with its teeth directly engaged by teeth on a pawl, for applying rotational torque directly to the peripheral surface of the socket. Permanent magnets supported in the wrench head maintain the socket in easily releasable operational engagement with the wrench.

17 Claims, 2 Drawing Sheets

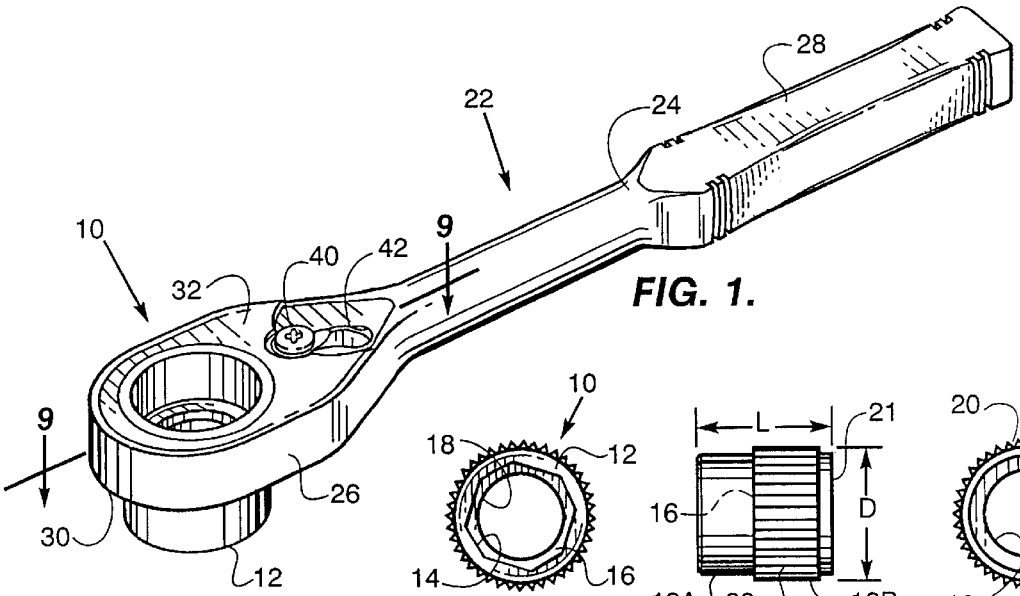
FIG. 1.
FIG. 2A.
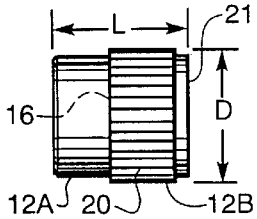
FIG. 2.
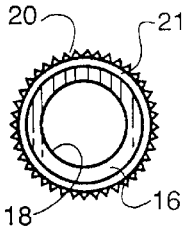
FIG. 2B.
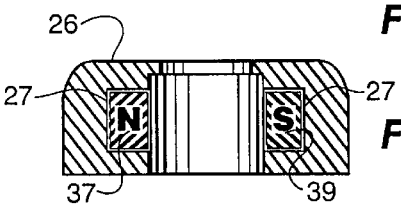
FIG. 5.
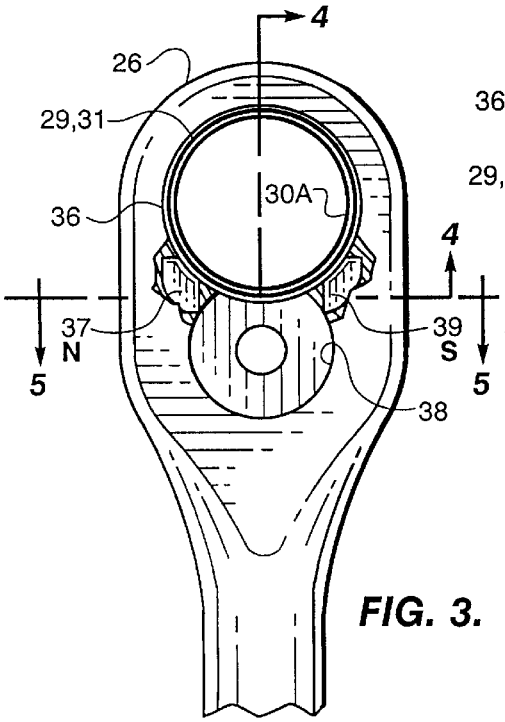
FIG. 3.
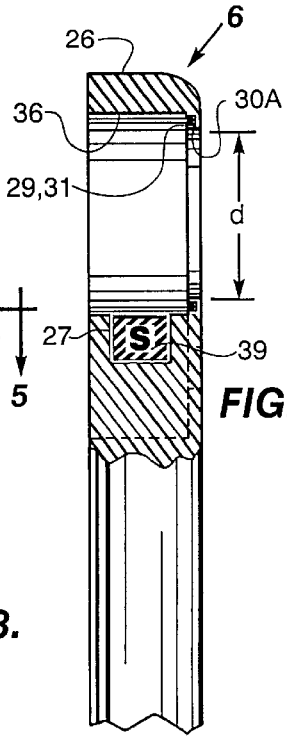
FIG. 4.
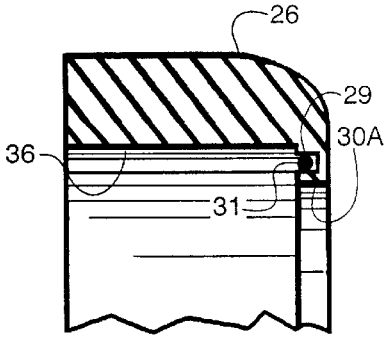
FIG. 6.
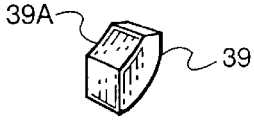
FIG. 8.

LOW-PROFILE RATCHET WRENCH HAVING MAGNETICALLY RETAINED THIN-WALLED SOCKETS

BACKGROUND OF THE INVENTION

1. Field of the Invention

This invention relates to socket wrenches having a ratcheting function and, more particularly, to a ratchet wrench characterized by short, thin-walled hollow sockets, and a relatively thin handle having a cylindrical opening in which a socket is releasably maintained. A pawl supported within the handle and extending into the opening engages and applies rotational torque directly to a peripheral surface of a socket.

2. Description of the Prior Art

Ratchet wrenches have long been used where bolts and nuts must be installed and removed in machines and equipment of various description. Socket kits or sets usually include a ratchet wrench, various adapters, accessories and attachments, and a plurality of sockets used interchangeably with the ratchet wrench. The usual ratchet wrench comprises a drive handle having a square driving lug which fits into a square opening in one end of a socket which, for example, may constitute a ¼", ⅜" or ½" square lug drive. At the other end the socket has an opening, usually hexagonal, for engagement with a correspondingly sized fastener, such as a nut or head of a bolt. The hexagonal openings range in size from ⅜" to 1⅛" in sixteenth inch intervals. The driving lug conventionally has a spring-loaded ball that engages a recess formed in the square socket opening for keeping the wrench and socket in releasable operative engagement.

The head end of wrenches in current use includes a housing which receives a rotating drum carrying the lug drive and is provided with external splines for engagement by a ratchet pawl, the position of which determines the direction of drive rotation of the lug. The pawl is operated by manipulating a pin or lever to selectively engage and disengage the pawl to and from the drum splines and facilitate rotation of the lug drive in either a clockwise or counterclockwise direction.

The lug drive is integral with and projects outwardly from the rotating drum, and sockets of various sizes having drive apertures dimensioned to receive the lug are fitted to the lug drive and seat against the drum. Accordingly, to accommodate a ratchet wrench of this type, the work space must be at least as wide as the length of the socket, which may be about two inches for a socket with a standard ¾" drive opening, plus the width of the wrench housing. In many situations, for example the cramped quarters of an automobile engine, the work space will not permit access of conventional ratchet wrenches because of the combined thickness of the housing and socket.

It is an object of this invention to provide a ratchet wrench system which has an effective work thickness much less than that of the wrench housing, lug drive and socket combination of a conventional wrench of comparable size.

Another object of this invention is to provide a low-profile ratchet wrench that is smaller and lighter in weight than a conventional wrench of comparable fastener size and strength.

Another object of the invention is to provide a ratchet wrench wherein a portion of the length of the socket is received in a cylindrical opening extending through the wrench handle, thereby to reduce the overall thickness of the system and enable the handle to apply rotational torque to an exterior surface of the received portion of the socket.

Another object is to provide a ratchet wrench system wherein the handle has the capability of magnetically picking up a socket of any size at arms length.

Still another object of the invention is to provide a ratchet wrench system having thin-walled sockets which have an axial opening sufficiently large to allow a bolt engaged by a fastener of a size corresponding to the fastener opening of the socket to pass through the axial opening and extend beyond the nut.

The described low-profile advantage, and others of the above objects, are achieved in the ratchet wrench system described in Applicant's U.S. Pat. No. 5,857,390, dated Jan. 12, 1999, which comprises a wrench handle and a plurality of interchangeable hollow, thin-walled sockets. A portion of the length of a socket is received in a circular opening extending through the wrench handle, and a resilient steel spring supported in a circumferential groove formed in the wall of the circular opening engages a circumferential groove on an outer surface of the received portion of the socket for maintaining the handle and socket in easily releasable operative engagement.

While this patented wrench system is enjoying commercial acceptance, with the spring and groove detent mechanism performing satisfactorily, the requirement for a circumferential groove on the peripheral surface of each socket and also in the wall of the cylindrical opening, and the fabrication and the assembly of the resilient spring, complicate the manufacture of an otherwise straightforward product, with attendant increase in cost.

Accordingly, a more specific object of the invention is to provide alternative, less costly means for maintaining the socket in operative engagement with the wrench while permitting its easy removal.

SUMMARY OF THE INVENTION

Briefly, the ratchet wrench system in accordance with the present invention includes a wrench handle and a plurality of interchangeable sockets wherein a socket received in an opening through the handle is magnetically maintained in easily releasable operative engagement with the handle. More particularly, the ratchet wrench includes a relatively thin wrench head having a circular opening extending there-through and a pawl having teeth extending into the circular opening, and a plurality of sockets. Each socket is a thin-walled cylinder made of magnetically attractable material, preferably steel for its strength and durability. It is approximately twice as long as the thickness of the wrench body, and has an axial opening there-through, one end of which has surfaces for engaging a fastener of predetermined size. At the other end, a portion of the socket length generally corresponding to the thickness of the wrench head has an outside diameter corresponding to the diameter of the circular opening and a multiplicity of gear-like teeth uniformly spaced around its periphery adapted for cooperation with the pawl teeth.

The socket is maintained in easily releasable operative engagement with the wrench by magnetic means supported in the wrench head at a location to magnetically attract the toothed portion of a socket received in the wrench head opening. In a preferred embodiment, the requisite magnetic attraction is achieved with a pair of relatively small permanent magnets supported in respective pockets formed in the wrench head proximate the points at which the circular and pawl openings intersect, as close as possible to one another. The magnets are preferably alloys of magnetic "rare earth" elements, such as neodymium, that exhibit a strong magnetic pole strength. Being quite frangible, the magnets are slightly smaller than their respective pockets and are secured therein and protected by potting them in epoxy or other suitable material.

BRIEF DESCRIPTION OF THE DRAWINGS

Other objects, features and advantages of the invention will become apparent, and its construction and operation better understood, from the following detailed description when read with reference to the accompanying drawings, in which:

FIG. 1 is a perspective view of a ratchet wrench and socket assembly constructed in accordance with the invention;

FIGS. 2, 2A and 2B are side, left and right end views, respectively, of a socket constructed in accordance with the invention;

FIG. 3 is a fragmentary plan view of the head of the ratchet wrench as viewed from below in FIG. 1;

FIG. 4 is a sectional view taken along line 4—4 in FIG. 3;

FIG. 5 is a sectional view taken along line 5—5 in FIG. 3;

FIG. 6 is an enlargement of a portion of FIG. 4;

FIG. 8 is a perspective view of one of the magnets; and

DESCRIPTION OF THE PREFERRED EMBODIMENT

Figure 7:
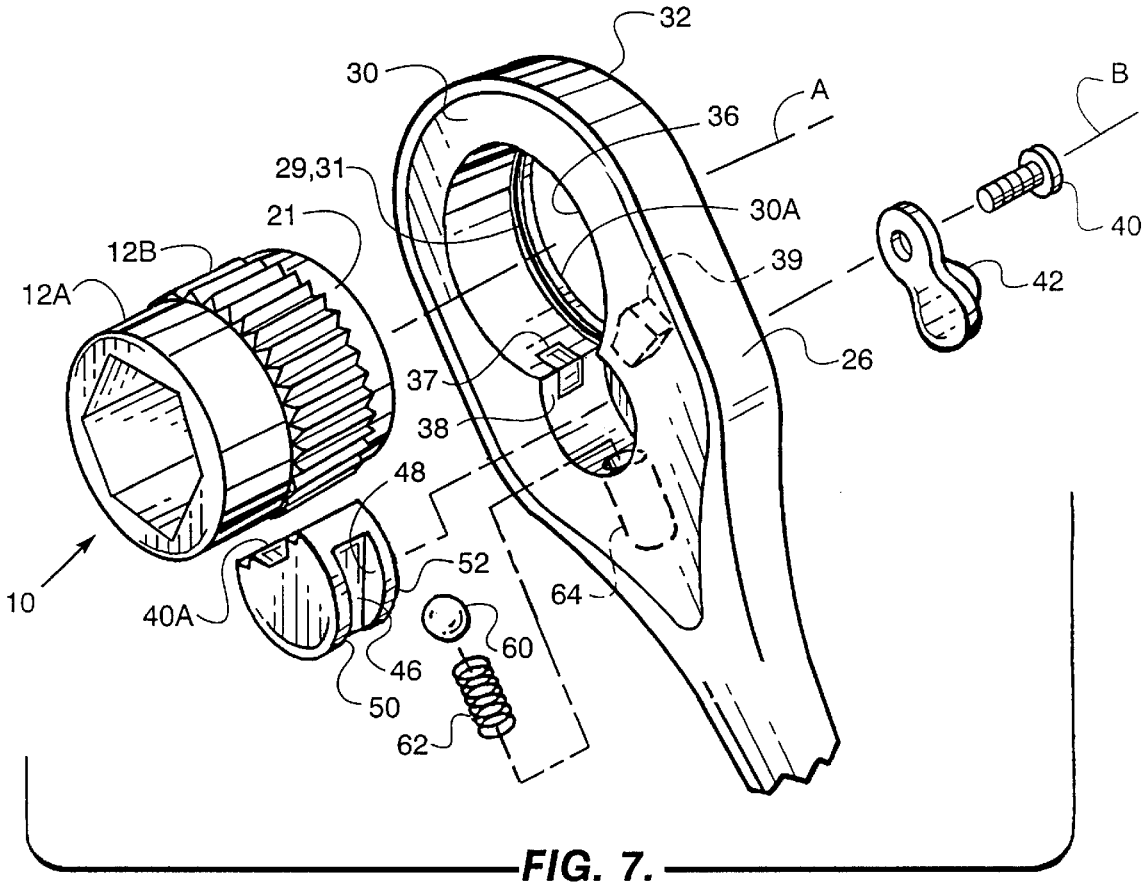
FIG. 7 is an exploded perspective view of the wrench head and socket.

The socket wrench system according to the invention includes a set of interchangeable sockets graduated according to the size of their fastener-receiving openings, and a reversible ratchet wrench for manually applying rotational force to a selected socket. FIGS. 2, 2A and 2BB are respectively side, left end and right end views, of a representative socket 10 of a set, and comprises a generally cylindrical body 12 having a length L consisting of collinearly joined first and second cylindrical body portions 12A and 12B of approximately equal length. The socket is made of a magnetically attractable material, preferably steel, so as to be attracted by magnets supported in the head of the ratchet wrench. A fastener-receiving opening 14, typically a 6-point hexagonal opening, extends inwardly from one end of body portion 12A to a depth determined by the size of the bolt head or nut to be turned and is bottomed at a relatively thin transverse wall 16. A round axial opening 18 extends inwardly from the other end of body portion 12B, through transverse wall 16, to connect with the fastener-receiving opening. The axial opening is sufficiently large to allow a bolt engaged by a nut of a size corresponding to the fastener-receiving opening to pass through the opening and extend beyond the nut and the wrench head, should operational circumstances require. The outer surface of first body portion 12A may be completely round or hexagonal, or may have a pair of diametrically opposed flat surfaces to prevent rolling of the socket and on which size indicia may be inscribed.

The second body portion 12B has a circular cylindrical peripheral surface having a diameter D, around which a multiplicity of teeth 20, typically thirty-six, of the same length as body portion 12B, are uniformly spaced as in a gear. The second body portion 12B has a short cylindrical extension 21 projecting from its free end, the outside diameter of which is slightly smaller than the outside diameter of body portion 12B, the purpose of which will be described presently.

Referring to FIGS. 1 and 3–8, a reversible ratchet wrench 22 for applying rotational torque directly to the toothed peripheral surface of body portion 12B includes a body 24 having a head 26 and an integral handle 28 extending therefrom. In a preferred embodiment the wrench is made of non-magnetic material, such as non-magnetic stainless steel or titanium, so as not to become magnetized by the contained magnets (to be described) which might adversely affect the effective strength of the magnets. The thickness of the wrench head 26, defined by the opposing parallel planar surfaces 30 and 32, substantially corresponds to the length of the second body portion 12B of socket 10. Wrench head 26 has a circular opening 36, of substantially the same diameter as the toothed body portion 12B of socket 10, which extends inwardly from planar surface 30 toward planar surface 32 until stopped by a thin annularly-shaped peripheral shoulder 30A having an inside diameter, d, which is slightly smaller than opening 36, but is slightly larger than the outside diameter of the socket extension 21. As a socket is received in the opening 36, socket extension 21, which is about the same length as the thickness of shoulder 30A centers the socket; the shoulder limits the depth of insertion of the socket and because its thickness is substantially equal to the length of extension 21, the annularly-shaped outer end of the extension is substantially flush with the upper face 32 of the wrench head, thereby to provide an accessible surface for the user to apply an axial force, by thumb or finger pressure, for instance, for disengaging and removing a retained socket.

The wrench head also has a circular pawl-receiving opening 30 which extends inwardly from planar surface 30 to a depth just short of shoulder 30A. Opening 38 has a significantly smaller diameter than opening 36 and slightly overlaps circular opening 36. The overlapping of the differently sized circular openings 36 and 38 gives the opening the shape of an unsymmetrical figure-"8" having a narrow waist located proximate the points at which openings 36 and 38 intersect.

A socket is maintained in easily releasable operational engagement with the wrench with a pair of small permanent magnets 37 and 39. The magnets are received and secured within respective generally crescent-shaped pockets 33 and 35, formed by milling for example, located in the intersecting cylindrical walls of openings 36 and 38 at locations astraddle the waist of the opening. At their widest the pockets extend about 3/16-inch into the wrench head, and are located approximately midway between the wrench head faces 30 and 32; this hides the magnets from view and protects them against physical damage.

This location of the pockets positions the magnets in the closest possible proximity to one another, and to the circular opening 36 and a contained socket as well, and as seen in FIGS. 7 and 8, each magnet has an inwardly facing circularly contoured surface 39A (FIG. 8) substantially corresponding to the curvature of opening 36. To protect against a received socket touching and possibly damaging the magnets during use, the radius of curvature of the curved surface 39A is slightly larger than the radius of the circular opening. To protect against the magnets being touched by and possibly damaged by the pawl, they are shaped and dimensioned such that when in place their lower ends (as viewed in FIG. 3) do not extend into the pawl opening 38.

The magnets preferably are fabricated from an alloy of one of the several elements known as "rare earth" elements, or lathinides, of atomic number 57 through 71. These alloys, of which a neodymium alloy is suitable and commerially available, exhibit a strong magnetic pole strength per unit volume, and may be fabricated, using known powder metallurgy techniques, into magnets of the desired shape and size. Using known apparatus and techniques, the fabricated magnets are magnetized and then inserted and secured in their respective pockets 33 and 35. In the illustrated example, magnets 37 and 39 are magnetized in a direction to respectively exhibit North and South poles facing the upper face 32 of the wrench head. As there can be no single, isolated poles, magnets 37 and 39 have equivalent South and North poles, respectively, facing in the opposite direction.

Such "rare earth" alloys being quite friable, the magnets tend to be easily broken or abraded if struck or rubbed. While the pockets in which the magnets are secured protect them from direct blows, vibratory forces and mechanical shocks encountered during socket insertion or removal may cause breakage. To protect against damage, the magnets are cushioned by an epoxy resin which not only fastens them in their respective pockets but also acts as a shock absorber and vibration dampener. More particularly, the magnets are made slightly smaller than their respective pockets and potted therein with epoxy resin 27 or other suitable adhesive material. The epoxy also coats the inwardly facing curved surface 39A, thus covering the entire magnet.

The magnetic circuit for attracting and releasably holding a socket in the wrench further includes a ring 29 made of magnetically-attractable material which is supported on shoulder 30A at a location where it is adapted to be contacted by the inner end of portion 12B of a seated socket. Ring 29 may be made of small diameter steel wire, typically 1/32-inch in diameter, and is press-fitted into a groove 31 formed in the inwardly facing annular-shaped surface of shoulder 30A. The depth of groove 31 is so related to the wire diameter of ring 29 as to slightly expose the ring so that it is contacted by the inner end of a received socket.

To assemble the wrench and a selected socket, the user grasps the wrench handle 22 in one hand, and with the other inserts the toothed portion 12B of a socket 10 into the socket opening 36, from the underside of the head as viewed in FIG. 1. As the socket first enters the opening, it is attracted by the magnets and is drawn further into the opening, but not fully seated. Upon application of slight axial pressure to its fastener end, the socket is snapped into the seated position, with its extension 21 extending through the opening in shoulder 30A and the inner end of toothed portion 12B firmly pressed against the shoulder.

This action is believed to result from the lines of force of the magnetic field generated by magnets 37 and 39 passing through and attracting the magnetically-attractable socket, and also through the magnetically attractable ring 29. The socket acts as a "keeper" for the magnets which, as will be recalled from grammar school science experiments, requires less force to slide it off—than to pull it from—the poles of the magnet. This principle applies here because of the inherent sliding relationship between the socket and the magnets and, therefore, a factor in determining the field strength of the magnets. Hypothetically, while the field strength may be sufficiently strong that the socket and wrench can be handled as a unit with minimum risk of disengagement, it may, however, be inadequate to satisfy ANSI pull-out specifications for socket wrenches.

The ring 29, made of magnetically-attractable material and embedded in shoulder 30A in the wrench head, makes it possible to achieve the requisite holding strength with relatively weak magnets. As previously noted, the ring 29, supported near the magnets on the non-magnetic head, together with the magnets forms a magnetic circuit in which the magnetic lines of force tend to be confined to the shoulder 30A portion of the wrench head. Unlike the sliding relationship between the socket and magnets, in this case the socket is disengaged by pulling it away from the magnetized ring 29, which requires greater force. This phenomenon, coupled with the close proximity of the magnets to one another and to the steel ring, makes it possible to produce with magnets of small physical size, the magnetic attraction necessary to maintain the socket in sufficiently firm engagement with the wrench that they can be handled as a unit without risk of disengagement, yet not so strong that a socket can't be easily removed. For example, in an 8-inch wrench having a 9/16-inch head thickness and a 3/4-inch diameter circular opening 36, magnets which each cubed out to approximately 3/16-inch by 1/4-inch by 3/8-inch, produced the magnetic attraction necessary to satisfy ANSI's four-pound pull-out specification.

On the other hand, the magnetic force needed to retain the socket can be overcome relatively easily when it is desired to disengage the socket from the wrench head for interchange purposes, for instance. The user only has to exert a relatively small axial force on the socket, for instance, by grasping the wrench head and applying thumb pressure to the annularly-shaped end surface of the extension 21.

A generally round pawl 40 is received within the opening 38 and supported for rotation around a pawl axis B that is spaced from and parallel to the rotational axis A of a socket 10 received in the circular opening 36. Pawl 40 has two spaced sets of teeth 40A and 40B that selectively engage the teeth 20 of a socket 10 for preventing rotation of the socket relative to the wrench in one direction or the other depending upon the position of the pawl. The direction of locking of the socket against rotation is controlled by thumb movement applied to an integral tab 42 on the pawl 40 to rotate it about axis B and thereby engage the socket teeth 20 with one or the other of pawl teeth 40A or 40B. Engagement of the pawl teeth with the socket teeth 20 is maintained by a spring biaser 44, to be described presently.

Being of substantially the same length as the thickness of the wrench head, the teeth 20 of an engaged socket extend between the opposing planar faces of the wrench head, as do the pawl teeth, there is uninterrupted engagement of these toothed surfaces when the pawl is engaged. This permits a thin wrench to apply a large amount of torque to the toothed peripheral surface of a socket. The thin wrench construction, coupled with the shorter thin-walled hollow socket received within the wrench body, makes for a very low profile, and also allows the system to be manufactured with less material and at less cost than conventional ratchet wrench systems.

Figure 9:
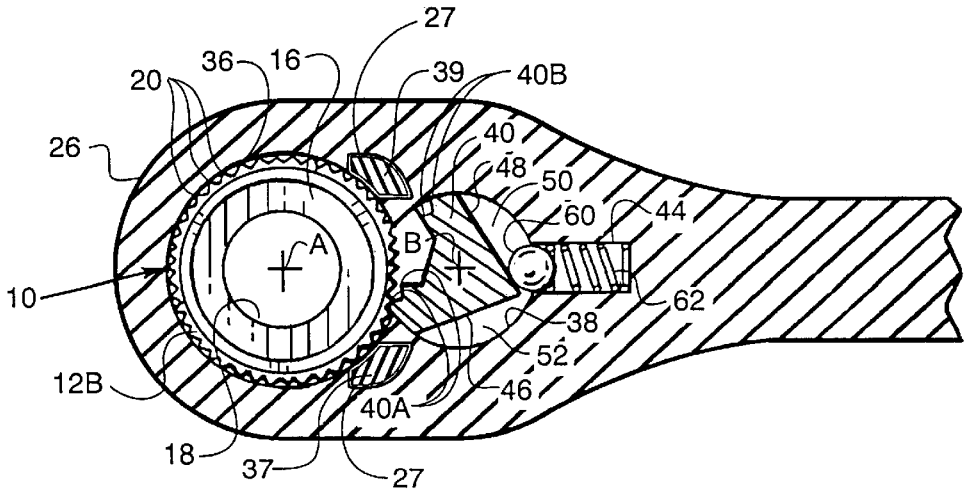
FIG. 9 is a sectional view taken along line 9—9 of FIG. 1.

As seen in FIGS. 7 and 9, pawl 40 has a pair of positioning surfaces 46, 48 against which spring biaser 44 acts to provide overcenter positioning of the pawl to engage one or the other of the sets of pawl teeth with the socket teeth 20. The pawl has spaced skirts 50 and 52 between which the positioning surfaces 46 and 48 are located; each positioning surface is flat and defines an associated notch between the spaced skirts. The spring biaser includes a ball 60 and a helical compression spring 62, one end of which is seated in a hole 64 and at the other end urges ball 60 against the notches of pawl 40 to provide the overcenter positioning of the pawl.

The presence of the magnets in the handle gives it the unique ability to pick up, at arm's length, a magnetically-attractable socket of any size, so that the user doesn't have to get up to get another otherwise out-of-reach socket. The magnetic field is sufficiently strong to attract and move a socket, regardless of its orientation relative to the wrench head opening.

While the best mode for carrying out the invention has been described in detail, it will now be evident to those familiar with the art to which the invention relates that various changes may be made in the invention without departing from its spirit and scope. For example, although a wrench handle made of non-magnetic material is presently preferred, it is within the contemplation of the invention to make it of a magnetic material, such as ordinary steel; use of a magnetic material for the handle would obviate the need for the ring 29. Therefore, the invention is not limited by that which is shown in the drawings and described in the specification, but only as indicated in the appended claims.

I claim:

1. A low-profile ratchet wrench system comprising, in combination:

a wrench body including a head and an integral handle extending from the head, said head having a thickness defined by opposing upper and lower faces, a circular socket opening having a cylindrical wall extending inwardly form said lower face substantially through said head, and a circular pawl-receiving opening extending inwardly from said upper face and partially overlapping the circular socket opening;

pawl means supported within the pawl-receiving opening and including teeth extending into the circular socket opening;

a socket comprising a cylindrical body having first and second collinear portions, said first portion having an outer diameter corresponding to the diameter of said circular socket opening and a length corresponding to the thickness of the wrench head adapted to be received in said circular socket opening, said first portion having a multiplicity of gear-like teeth uniformly spaced around its periphery for cooperating with the teeth of said pawl means, and said second portion having an axial opening therein having surfaces for engaging a fastener of a predetermined size; and magnet means including permanent magnets supported in the wall of said circular socket opening at a location proximate the points at which said circular opening intersects said pawl-receiving opening to magnetically attract the first portion of a socket received in said socket opening for maintaining the socket in easily removable operative engagement with the wrench, whereby a plurality of sockets all having like first portions and each having an axial opening in the second portion dimensioned to engage fasteners of different predetermined sizes may easily be interchangeably inserted and removed form the socket opening in the wrench head.

2. A low-profile ratchet wrench system as defined in claim 1, wherein said circular socket opening extends inwardly toward the upper face of said head until stopped by a thin peripheral shoulder having an inside diameter slightly smaller than the diameter of said socket opening;

wherein the first body portion of said socket has a short extension projecting from the end of said first portion, said extension having an outside diameter slightly smaller than the inside diameter of said peripheral shoulder; and wherein said magnet means comprises first and second permanent magnets supported within respective pockets formed in the wrench head.

3. A low-profile ratchet wrench system as defined in claim 2, wherein said pockets are located proximate the points where said partially overlapping socket and pawl openings intersect one another and substantially midway between the upper and lower faces of said wrench head.

4. A low-profile ratchet wrench system as defined in claim 3, wherein said magnets are made from a rare earth element exhibiting a strong magnetic pole strength, and wherein said magnets are secured with epoxy within their respective pockets for protection against breakage.

5. A low-profile ratchet wrench system as defined in claim 4, wherein said first and second magnets each has a confronting curved surface having a radius of curvature approximating the radius of said socket opening.

6. A low-profile ratchet wrench system as defined in claim 2, wherein said wrench body is made of non-magnetic material;

wherein said magnets are supported substantially midway between the upper and lower faces of the wrench head and proximate the points where said socket and pawl openings intersect one another; and wherein said magnet means further comprises a ring made of magnetically-attractable material supported on said peripheral shoulder.

7. A low-profile ratchet wrench system as defined in claim 6, wherein said ring is made of small diameter steel wire and is supported in the inwardly facing annular surface of said peripheral shoulder.

8. A low-profile ratchet wrench system as defined in claim 7, wherein said ring is fitted in a groove formed in the inwardly facing annular surface of said peripheral shoulder.

9. A low-profile ratchet wrench system as defined in claim 1, wherein the first body portion of the socket has thirty six gear-like teeth uniformly spaced around its periphery.

10. For use in a ratchet wrench system including a ratchet wrench and a cylindrical hollow socket having gear-like teeth uniformly spaced around the periphery of a portion of its length and a short extension projecting from the end of said portion, a ratchet wrench comprising:

a wrench body including a head and an integral handle extending form the head, said head having a thickness defined by opposing upper and lower faces and includes a circular socket-receiving opening having a cylindrical wall and an axis extending inwardly form said lower face substantially to said upper face and stopped by an annularly-shaped peripheral shoulder having an inside diameter smaller than the diameter of said socket opening and slightly larger than the diameter of said socket extension, and a thickness approximating the length of said socket extension, and a circular pawl-receiving opening that partially overlaps the circular socket-receiving opening;

pawl means supported within said pawl-receiving opening for rotation about a pawl axis parallel to the axis of the circular socket-receiving opening and including spaced apart teeth which extend into the socket-receiving opening adapted to directly engage the teeth on a peripheral surface of a cylindrical socket received within the circular socket-receiving opening; and magnet means including permanent magnets supported in the wall of said circular socket-receiving opening at a location proximate the points at which said circular opening intersects said pawl receiving opening to magnetically attract a received socket for maintaining the socket and wrench in easily releasable operative engagement.

11. A ratchet wrench as defined in claim 10, wherein said wrench body is made of non-magnetic material; and wherein said magnet means comprises first and second permanent magnets supported within respective pockets formed in the wrench head, and a ring made of magnetically-attractable material supported on said peripheral shoulder.

12. A ratchet wrench as defined in claim 11, wherein the pockets supporting said magnets are located proximate the points where said partially overlapping socket and pawl openings intersect one another and substantially midway between the upper and lower faces of said wrench head.

13. A ratchet wrench as defined in claim 12, wherein said permanent magnets are made from an alloy of a rare earth element exhibiting a strong magnetic pole strength, and wherein said magnets are secured with epoxy within their respective pockets for protecting the magnets against breakage.

14. A ratchet wrench as defined in claim 13, wherein said first and second magnets each have a confronting curved surface having a radius of curvature approximating the radius of curvature of said socket opening.

15. A low-profile ratchet wrench system comprising, in combination:

a wrench body made of non-magnetic material and including a head and an integral handle extending from the head, said head having a thickness defined by opposing upper and lower faces, a circular socket opening extending inwardly from said lower face substantially to said upper face and stopped by an annularly-shaped peripheral shoulder having an inside diameter slightly smaller than the diameter of said socket opening, and a circular pawl-receiving opening extending inwardly from said lower face and partially overlapping said circular socket opening;

pawl means supported within the pawl-receiving opening and including teeth extending into the circular socket opening;

a socket comprising a hollow cylindrical body having first and second collinear portions, said first portion having an outside diameter corresponding to the diameter of the circular socket opening in said wrench head and a length corresponding to the thickness of the wrench head and adapted to be received in said circular socket opening, said first portion having a multiplicity of gear-like teeth uniformly spaced around its periphery for cooperating with the teeth of said pawl means, and an extension projecting from said first portion having an outside diameter slightly smaller than the inside diameter of said peripheral shoulder and a length approximating the thickness of said peripheral shoulder and adapted to be received in the opening defined by said shoulder upon insertion of a socket into said socket opening, and the second portion of said socket having an axial opening therein having surfaces for engaging a fastener of a predetermined size; and means for magnetically maintaining a socket in easily removable operative engagement with the wrench comprising first and second permanent magnets secured with epoxy in respective pockets formed in the wrench head at locations proximate the points at which said partially overlapping socket and pawl openings intersect one another and substantially midway between the upper and lower faces of the wrench head, and a ring made of magnetically-attractable material supported on said annularly-shaped shoulder;

whereby a plurality of sockets all having like first portions and each having an axial opening in the second portion dimensioned to engage fasteners of different predetermined sizes may easily be interchangeably inserted and removed from the socket opening in the wrench head.

16. A low-profile ratchet wrench system as defined in claim 15, wherein said permanent magnets are made from an alloy of a rare earth element exhibiting strong magnetic pole strength.

17. A low-profile ratchet wrench system comprising, in combination, a ratchet wrench having a head with a pawl-receiving opening partially overlapping a circular socket opening having a cylindrical wall therethrough for receiving a selected one of a plurality of interchangeable cylindrical wrench sockets, each of which has a first portion adapted to be removably retained in the circular opening by permanent magnets supported in the wall of said circular opening at a location proximate the points at which said circular opening intersects said pawl-receiving opening to magnetically attract a socket when a first portion of a socket is received in said circular opening for maintaining a socket in operative combination with a ratchet wrench while permitting its easy removal from the wrench, thereby making the sockets quickly and easily interchangeable, said first portion of each socket having thereon a multiplicity of gear teeth distributed around the periphery thereof arranged to be directly engaged by a pawl mechanism supported in the pawl-receiving opening in communication with said circular opening.

* * * * *